US006264116B1

(12) United States Patent
Harcombe et al.

(10) Patent No.: US 6,264,116 B1
(45) Date of Patent: Jul. 24, 2001

(54) FUEL INJECTOR

(75) Inventors: Anthony Thomas Harcombe, Richmond; Robert Keith Cross, Banstead, both of (GB)

(73) Assignee: Lucas Industries (GB)

( * ) Notice: Subject to any disclaimer, the term of this patent is extended or adjusted under 35 U.S.C. 154(b) by 0 days.

(21) Appl. No.: 09/396,131

(22) Filed: Sep. 14, 1999

(30) Foreign Application Priority Data

Sep. 18, 1998 (GB) ..... 9820239

(51) Int. Cl.[7] ..... F02M 51/00; B05B 1/30
(52) U.S. Cl. ..... 239/124; 239/585.1
(58) Field of Search ..... 239/5, 88, 95, 239/124, 533.3, 533.9, 585.1

(56) References Cited

U.S. PATENT DOCUMENTS

| | | | | |
|---|---|---|---|---|
| 5,042,718 | * | 8/1991 | Bergmann et al. | 239/88 |
| 5,531,382 | * | 7/1996 | Buckley et al. | 239/124 |
| 5,628,293 | * | 5/1997 | Gibson et al. | 239/88 X |
| 5,660,331 | * | 8/1997 | Cooke | 239/124 |
| 5,860,597 | * | 1/1999 | Tarr | 239/124 |
| 5,967,413 | * | 10/1999 | Tian | 239/88 |
| 6,027,047 | * | 2/2000 | Augustin | 239/533.3 |

FOREIGN PATENT DOCUMENTS 0 823 550 A1 2/1998 (EP) .

* cited by examiner

*Primary Examiner*—Lesley D. Morris
(74) *Attorney, Agent, or Firm*—Wells St. John Roberts Gregory & Matkin

(57) ABSTRACT

A fuel injector comprising a valve needle biased by a spring into engagement with a seating, a surface associated with the valve needle being exposed to fuel pressure within a control chamber and restricted communication structure providing a restricted flow path between a supply passage and the control chamber. The fuel injector further comprises a drain valve controlling communication between the supply passage and a low pressure reservoir and an injection control valve controlling communication between the control chamber and the low pressure reservoir, the drain valve and the injection control valve being moveable under the control of a single electromagnetic actuator including an armature common to both valves. The injection control valve, the drain valve and the actuator are arranged such that at rest, the injection control valve and the drain valve are open, when the actuator is energized to a first, relatively low energization level the drain valve is closed and the injection control valve is open, and when the actuator is energized to a second, higher energization level, the drain valve and the injection control valve are both closed. A method of operating a fuel injector includes energizing an actuator to a second, higher level to close drain and injection control valves when pressurization of fuel is to commence.

12 Claims, 1 Drawing Sheet

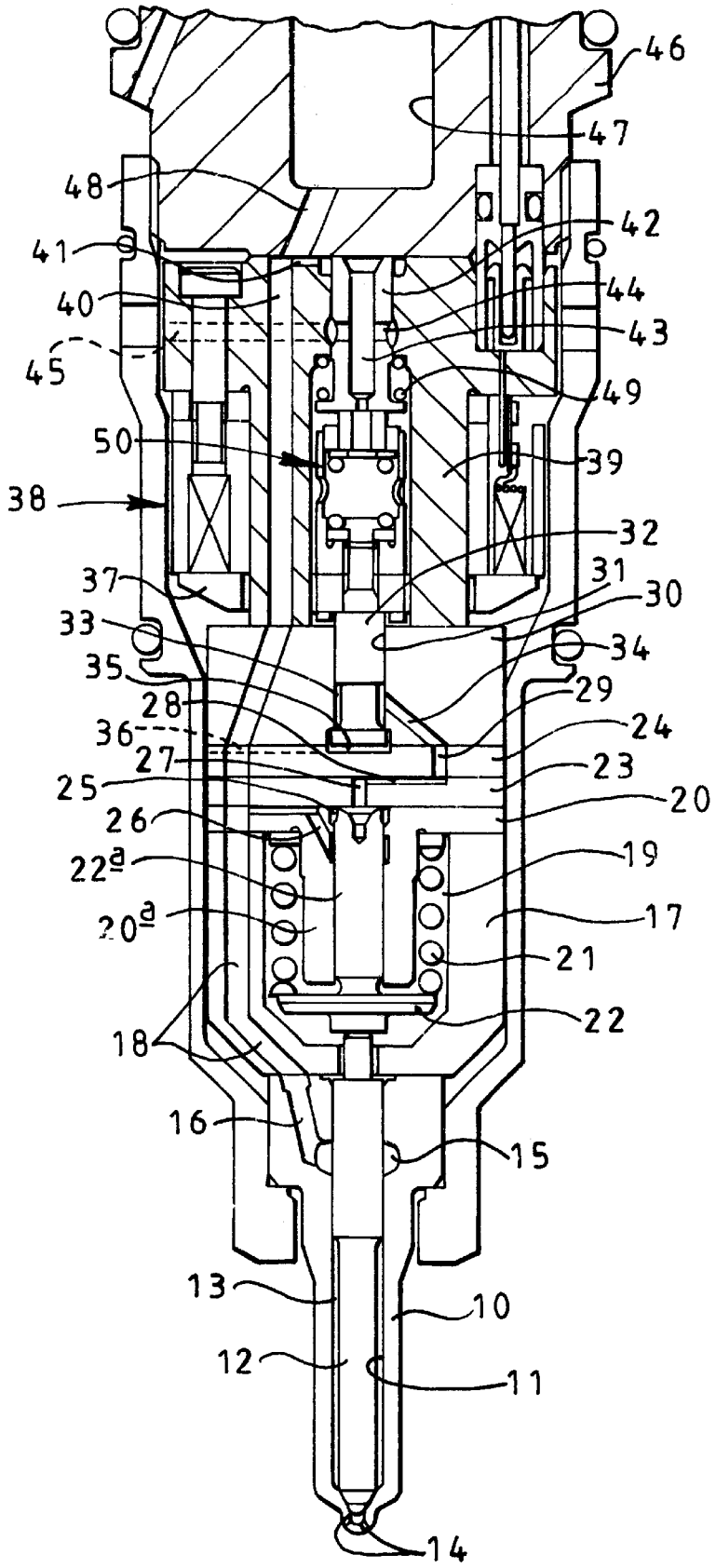
46
47
48
42
41
44
40
43
45
49
50
39
38
32
37
31
30
33
34
35
29
28
24
36
27
23
25
20
26
19
22a
17
20a
21
22
18
16
15
13
10
12
11
14

FUEL INJECTOR

This invention relates to a fuel injector for use in delivering fuel under high pressure to a cylinder or combustion space of an associated engine. In particular, the invention relates to a fuel injector of the type in which the fuel pressure at the commencement of injection can be controlled independently of the timing of fuel injection. The invention also relates to a method of operation of such an injector.

It is known, in a unit injector arrangement, to use separately actuated spill or drain valves and injection control valves to permit the timing of injection and the injection pressure to be controlled independently. It is also known to control the spill or drain valve and the injection control valve of a unit injector using a single actuator including an armature common to both valves. In a typical arrangement, when injection is to be terminated the injection control valve is closed to permit the fuel pressure within a control chamber to rise, the increased fuel pressure within the control chamber forcing the injector needle into engagement with its seating to terminate injection. Forcing the needle into engagement with its seating against a relatively high injection pressure in this manner can cause the generation of undesirably high smoke and particulate emissions. It is an object of the invention to provide a fuel injector in which this disadvantage is overcome.

According to the present invention there is provided a fuel injector comprising a valve needle biased by a spring into engagement with a seating, a surface associated with the needle being exposed to the fuel pressure within a control chamber, restricted communication means providing a restricted flow path between a supply passage and the control chamber, a drain valve controlling communication between the supply passage and a low pressure reservoir, an injection control valve controlling communication between the control chamber and the low pressure reservoir, the drain valve and the injection control valve being moveable under the control of a single electromagnetic actuator including an armature common to both valves, wherein the injection control valve, the drain valve and the actuator are arranged such that at rest, the injection control valve and the drain valve are open, when the actuator is energized to a first, relatively low energization level the drain valve is closed and the injection control valve is open, and when the actuator is energized to a second, higher energization level, the drain valve and the injection control valve are both closed.

In such an arrangement, injection is terminated by de-energizing the actuator, thereby allowing the drain valve to open. As, immediately prior to the drain valve opening, the injection control valve is already open, termination of injection occurs under the action of the spring biasing of the injector needle against a reduced injection pressure rather than due to the increase of fuel pressure within the control chamber. The risk of production of excessive smoke and particulates emissions is reduced.

The responsiveness of the injector may be improved by reversing the polarity of the connections of the supply to the actuator when the energization level of the actuator is to be reduced rather than simply allowing the actuator current to decay.

The injector conveniently takes the form of a unit pump/injector.

According to another aspect of the invention there is provided a method of operating an injector of the type defined hereinbefore comprising the steps of:

energizing the actuator to its second, higher level to close the drain and injection control valves when the pressurization of fuel is to commence;

allowing the energization level of the actuator to fall to its first level to allow the injection control valve to open when injection is to commence; and de-energizing the actuator to allow the drain valve to open when injection is to terminate.

The step of allowing the energization level of the actuator to fall may include reversing the polarity of the connections between a supply and the actuator.

The invention will further be described, by way of example, with reference to the accompanying drawing which is a sectional view of part of a unit pump/injector in accordance with an embodiment of the invention.

The unit pump injector illustrated in the accompanying drawing comprises a nozzle body 10 having a blind bore 11 formed therein. The blind bore 11 defines, adjacent its blind end, a conical seating with which a conical part of a valve needle 12 is engageable. The valve needle 12 and bore 11 together define a delivery chamber 13, the engagement between the needle 12 and the seating controlling fuel flow from the delivery chamber 13 past the seating to one or more outlet openings 14 provided in the nozzle body 10. The needle 12 includes angled thrust surfaces exposed to the fuel pressure within the delivery chamber 13, thus the application of fuel under pressure to the delivery chamber 13 applies a force to the needle 12 urging the needle 12 away from its seating.

The bore 11 includes a region of enlarged diameter defining an annular gallery 15 which communicates with a drilling 16, forming part of a supply passage, provided in the nozzle body 10. The needle 12 is provided with flutes or other formations which permit fuel to flow from the annular gallery 15 to the delivery chamber 13.

The end of the nozzle body 10 remote from the blind end of the bore 11 abuts a spring housing 17 which is provided with drillings 18 forming part of the supply passage. The spring housing 17 includes a through bore extending coaxially with the bore 11, the through bore including a region of enlarged diameter defining a spring chamber 19. The enlarged part of the bore of the spring housing 17 is closed by a closure member 20 including an integral, axially extending projection 20*a* which acts to guide a spring 21 located within the spring chamber 19. The spring 21 engages a spring abutment member 22 which, in turn, engages an end of the needle 12 remote from the part thereof which is engageable with the seating, the spring 21 urging the needle 12 towards the seating.

The spring abutment member 22 includes a region 22*a* which is slidable within a bore formed within the projection 20*a* of the closure member 20. The region 22*a* is a piston-like fit within the bore of the projection 20*a*.

The surface of the closure member 20 remote from the spring housing 17 abuts a first distance piece 23 which, in turn, abuts a second distance piece 24. The first distance piece 23, the closure member 20 and the upper end part of the region 22*a* of the spring abutment member 22 together define a control chamber 25, the upper end of the region 22*a* defining a surface which is moveable with, and hence associated with, the valve needle 12 which is exposed to the fuel pressure within the control chamber 25 such that when the fuel pressure within the control chamber 25 is high, a large force is applied to the needle 12 assisting the spring 21 in urging the needle 12 towards its seating. The control chamber 25 communicates through a restricted clearance between the region 22*a* and the bore of the projection 20*a* with an annular chamber which communicates with a drilling 26, the drilling 26 communicating via a groove formed in the surface of the closure member 20 which abuts the first distance piece 23 with a drilling formed in the closure member 20 which forms part of the supply passage. The control chamber 25 further communicates through a drilling 27 formed in the first distance piece 23, and a groove 28 formed in the surface of the first distance piece 23 which abuts the second distance piece 24 with a drilling 29 formed in the second distance piece 24.

The second distance piece 24 abuts a control valve housing 30 including an axially extending through bore 31 within which a control valve member 32 is slidable. The control valve member 32 includes a region of enlarged diameter which is engageable with a seating defined by part of the bore 31 to control communication between an annular chamber 33 which communicates through a drilling 34 with the drilling 29 and a chamber 35 which communicates through a groove 36 formed in the surface of the second distance piece 24 which abuts the control valve housing 30 with a chamber defined, in part, between the control valve housing 30 and a cap nut, the chamber communicating, in use, with an appropriate low pressure fuel reservoir.

The control valve member 32 is coupled to an armature 37 moveable under the influence of the magnetic field generated, in use, by an electromagnetic actuator 38. The actuator 38 is located within a drain valve housing 39 which abuts the surface of the control valve housing 30 remote from the second distance piece 24. The drain valve housing 39 includes a drilling 40 forming part of the supply passage, the drilling 40 communicating through a groove 41 formed in the surface of the drain valve housing 39 remote from the control valve housing 30 with part of a through bore formed in the drain valve housing 39. A drain valve member 42 is slidable within the bore, the drain valve member 42 including an axially extending drilling 43 which communicates through cross-drillings 44 with a passage 45 communicating, in use, with the low pressure drain reservoir. The drain valve member 42 is engageable with a surface of a pump housing 46 which abuts the surface of the drain valve housing 39 remote from the control valve housing 30 to control communication between the passage 45 and the supply passage.

The pump housing 46 includes a bore 47 within which a pumping plunger is reciprocable under the influence of an appropriate cam and tappet arrangement, in conjunction with a return spring. The bore 47 communicates through a drilling 48 with the drilling 40 of the drain valve housing 39.

A spring 49 is provided to bias the drain valve member 42 away from the pump housing 46, ie towards an open position. A spring assembly 50 is provided between the drain valve member 42 and a part of the control valve member 32. In the illustrated embodiment, the spring arrangement 50 takes the form of a pre-assembled spring loaded capsule, the spring rate and pre-stressing of which can be set prior to introduction into the unit pump injector. However, it will be appreciated that other types of spring arrangement could be used to provide a resilient interconnection between the control valve member 32 and the drain valve member 42. The spring arrangement 50 transmits the action of the spring 49 to the control valve member 32, and thus urges the control valve member towards an open position.

In use, with the actuator 38 de-energized and with the bore 47 charged with fuel to a low pressure, the drain valve member 42 and the control valve member 32 are biased away from their seatings by the spring 49 and the spring arrangement 50. Inward movement of the plunger under the influence of the cam and tappet arrangement displaces fuel from the pump injector between the pump housing 46 and the adjacent end of the drain valve member 42, the fuel flowing through the axially extending passage 43, the cross-drillings 44 and the passage 45 to the low pressure drain reservoir. As fuel is able to escape from the unit pump injector, the fuel pressure within the delivery chamber 13 is relatively low, and as a result, the needle 12 remains in engagement with its seating under the action of the spring 21. Fuel injection is not taking place.

When it is determined that pressurization of fuel should commence, the actuator 38 is energized by applying a relatively high voltage thereto. The application of the relatively high voltage applies a relatively large magnitude attractive force to the armature 37 resulting in movement of the armature 37 to a fully lifted position. In this position, the control valve member 32 engages its seating. Additionally, the movement of the armature 37 is transmitted through the spring arrangement 50 to the drain valve member 42 which is able to move against the influence of the spring 49, moving into engagement with the pump housing 46. As a result of the energization of the actuator 38 to a relatively high level, it will be appreciated that both the control valve member 32 and the drain valve member 42 are moved into engagement with their respective seatings. Continued inward movement of the plunger is unable to displace fuel to the low pressure drain reservoir, thus the continued inward movement of the plunger pressurizes the fuel within the bore 47 and the parts of the pump injector in communication with the bore 47. As the control valve member 32 engages its seating, fuel is unable to escape from the control chamber 25, thus as the fuel pressure within the bore 47 increases, the fuel pressure within the control chamber 25 also increases, the fuel pressure within the control chamber 25 in conjunction with the spring 21 being sufficient to maintain the needle 12 in engagement with the its seating against the action of the fuel under pressure within the delivery chamber 13. It will therefore be appreciated that injection of fuel does not take place.

In order to commence injection, the actuator 38 is de-energized from its relatively high level to an intermediate level at which the attractive force applied to the armature 37 is insufficient to maintain the control valve member 32 in engagement with its seating against the action of the spring arrangement 50, the attractive force still being sufficient to ensure that the drain valve member 42 remains in engagement with its seating against the action of the spring 49. Such movement of the control valve member 32 permits fuel to escape from the control chamber 25 to the low pressure drain reservoir. As fuel is only able to flow to the control chamber 25 at a restricted rate, the fuel pressure within the control chamber 25 falls, and a point will be reached beyond which the fuel pressure within the control chamber 25 and the action of the spring 21 are insufficient to maintain the needle 12 in engagement with its seating. The needle 12 then rises from its seating thus permitting fuel to escape from the delivery chamber 13 past the seating to the outlet openings 14. Injection therefore takes place.

Although the actuator current may simply be allowed to decay to de-energize the actuator, the responsiveness of the injector may be improved by reversing the polarity of the connections between the source and the actuator, thereby positively driving the actuator towards its intermediate energization level. As a result, the control of the movement of the control valve member 32 is improved.

The movement of the needle 12 away from its seating is limited by the upper end of the region **22*a* abutting the first distance piece 23. The engagement of the region 22*a* with the first distance piece 23 closes the drilling 27, thus during subsequent fuel injection, the quantity of fuel which is able to escape from the supply passage through the control chamber 25 to the control valve 32 and low pressure drain is restricted. As illustrated, in order to ensure that a good seal is formed between the region 22***a* and the first distance piece 23, the end of the region 22*a* is shaped to define an annular seating area for engagement with the first distance piece 23 As the drilling 27 is closed, the fuel pressure applied to the part of the end surface of the region 22*a* will increase, but the increased pressure acts upon only a small effective area and is unable to move the needle 12 towards its seating.

In order to terminate injection, the actuator 38 is de-energized, the drain valve member 42 moving under the action of the spring 49 to permit fuel to escape from the bore 47 and passages in communication therewith to the low pressure fuel reservoir. As a result, the fuel pressure within the delivery chamber 13 is rapidly relieved thus the force urging the valve needle 12 away from its seating is reduced, and a point will be reached beyond which the needle 12 is able to return into engagement with its seating under the action of the spring 21. Once the needle 12 moves into engagement with its seating, injection is terminated.

After termination of injection, continued inward movement of the plunger displaces further fuel to the low pressure drain reservoir. Once the plunger reaches its innermost position, outward movement of the plunger under the action of the return spring draws fuel from the low pressure drain reservoir past the drain valve member 42, charging the bore 47 and passages in communication therewith with fuel at relatively low pressure. The injector is then ready for the commencement of the next injection cycle.

The arrangement described hereinbefore may be modified by replacing the clearance between the region 22*a* and the bore 20*a* which restricts the rate at which fuel is able to flow to the control chamber 25 with a passage of restricted dimensions. Regardless as to the nature of the restriction, one important function of the restriction is to restrict the quantity of fuel able to escape from the injector during the period in which the control valve is open but the needle has not reached its fully lifted position. By reducing the quantity of fuel escaping in this manner, the efficiency of the injector can be improved.

If the pump injector is to be used in an arrangement in which it is desired to provide a pilot injection followed by a main injection without de-pressurizing the injector between the pilot and main injections, then this may be achieved by arranging for the drilling 27 to remain unobscured throughout the range of movement of the needle 12 and modifying the control of the injector so that after commencement of injection, injection is interrupted by fully energizing the actuator 38 to move the control valve member 32 into engagement with its seating. Such movement breaks the communication between the control chamber 25 and the low pressure drain reservoir, thus permitting the re-pressurization of the control chamber 25 to an extent sufficient to cause the valve needle 12 to return into engagement with its seating without significantly de-pressurizing the fuel within the bore 47. When it is desired to commence the main injection, the actuator 38 is controlled in such a manner as to allow the control valve member 32 to move away from its seating whilst retaining the drain valve member 42 in engagement with its seating, thus relieving the fuel pressure from the control chamber 25 to allow the needle 12 to lift away from its seating as described hereinbefore. Termination of injection after the main injection is as described hereinbefore.

In the injector and the modifications described hereinbefore, it will be appreciated that as termination of injection occurs as a result of the spring returning the needle into engagement with its seating once the fuel pressure within the delivery chamber has fallen, the risk of the emission of undesirable high levels of smoke and particulates can be reduced.

What is claimed is:

1. A fuel injector comprising a valve needle biased by a spring into engagement with a seating, said valve needle having an associated surface which is exposed to fuel pressure within a control chamber, restricted communication means providing a restricted flow path between a supply passage and said control chamber, a drain valve controlling communication between said supply passage and a low pressure reservoir, an injection control valve controlling communication between said control chamber and said low pressure reservoir, said drain valve and said injection control valve being moveable under the control of a single electromagnetic actuator including an armature common to both valves, said injection control valve, said drain valve and said actuator being arranged such that at rest, said injection control valve and said drain valve are open, when said actuator is energized to a first, relatively low energization level said drain valve is closed and said injection control valve is open, and when said actuator is energized to a second, higher energization level, said drain valve and said injection control valve are both closed.

2. The fuel injector as claimed in claim 1, wherein said actuator is arranged to be positively driven from said second, higher energization level to said first, relatively low energization level to open said injection control valve whilst said drain valve remains closed.

3. The fuel injector as claimed in claim 1, wherein said drain valve and said injection control valve are in resilient interconnection.

4. The fuel injector as claimed in claim 3, wherein said drain valve and said injector control valve are interconnected by means of a spring arrangement.

5. The fuel injector as claimed in claim 1, including an abutment member in abutment with said spring, said abutment member defining said surface associated with said valve needle which is exposed to fuel pressure within said control chamber.

6. The fuel injector as claimed in claim 5, wherein said abutment member is reciprocable within a bore, said abutment member and said bore together defining at least a part of said restricted flow path between said supply passage and said control chamber.

7. The fuel injector as claimed in claim 5, wherein said abutment member is arranged such that, in use, when said injection control valve is closed, fuel leakage from said control chamber to said low pressure reservoir is minimized.

8. The fuel injector as claimed in claim 1, wherein said injector takes the form of a unit pump/injector.

9. A method of operating a fuel injector including a valve needle configured to be biased by a spring into engagement with a seating, the valve needle having a surface configured to be exposed to fuel pressure within a control chamber, restricted communication structure providing a restricted flow path between a supply passage and said control chamber, a drain valve controlling communication between said supply passage and a low pressure reservoir, an injection control valve controlling communication between said control chamber and said low pressure reservoir, said drain valve and said injection control valve being moveable under the control of a single electromagnetic actuator including an armature common to both valves, said injection control valve, said drain valve, and said actuator being arranged such that at rest, said injection control valve and said drain valve are open, when the actuator is energized to a first, relatively low energization level said drain valve is closed and said injection control valve is open, and when said actuator is energized to a second, higher energization level, said drain valve and said injection control valve are both closed, the method comprising the steps of:

energizing said actuator to its second, higher level to close said drain and injection control valves when pressurization of fuel is to commence;

allowing the energization level of said actuator to fall to its first level to allow said injection control valve to open when injection is to commence; and de-energizing said actuator to allow said drain valve to open when injection is to terminate.

10. The method as claimed in claim 9, wherein the step of allowing said energization level of said actuator to fall includes the step of positively driving said actuator to said first energization level by reversing the polarity of connections between an actuator supply and said actuator.

11. The method as claimed in claim 10, including the step of interrupting fuel injection following energization of said actuator to its first energization level by energizing said actuator to said second energization level to close said injector control valve so as to pressurize said control chamber to an extent sufficient to cause said valve needle to return into engagement with its seating without significantly de-pressurizing fuel within said supply passage, thereby providing a pilot injection of fuel subsequent to a main injection of fuel.

12. The fuel injector as claimed in claim 6, wherein said abutment member is arranged such that, in use, when said injection control valve is closed, fuel leakage from said control chamber to said low pressure reservoir is minimized.

* * * * *